US009685028B2

(12) United States Patent
Plowman

(10) Patent No.: US 9,685,028 B2
(45) Date of Patent: Jun. 20, 2017

(54) METHOD OF GAMING, A GAMING SYSTEM AND A GAME CONTROLLER

(75) Inventor: Gregory Leigh Plowman, Rosebery (AU)

(73) Assignee: ARISTOCRAT TECHNOLOGIES AUSTRALIA PTY LTD. (AU)

( * ) Notice: Subject to any disclaimer, the term of this patent is extended or adjusted under 35 U.S.C. 154(b) by 0 days.

(21) Appl. No.: 13/364,922

(22) Filed: Feb. 2, 2012

(65) Prior Publication Data

US 2012/0135796 A1 May 31, 2012

Related U.S. Application Data

(63) Continuation of application No. 11/970,355, filed on Jan. 7, 2008, now abandoned.

(30) Foreign Application Priority Data

Jan. 9, 2007 (AU) ..... 2007900072

(51) Int. Cl.
*G07F 17/32* (2006.01)

(52) U.S. Cl.
CPC ..... *G07F 17/32* (2013.01); *G07F 17/3262* (2013.01); *G07F 17/3267* (2013.01)

(58) Field of Classification Search
CPC ..... G07F 17/3267
USPC ..... 463/20
See application file for complete search history.

(56) References Cited

U.S. PATENT DOCUMENTS

| | | | | |
|---|---|---|---|---|
| 6,251,013 | B1 * | 6/2001 | Bennett | 463/13 |
| 6,290,600 | B1 * | 9/2001 | Glasson | 463/20 |
| 6,517,432 | B1 * | 2/2003 | Jaffe | 463/16 |
| 6,551,187 | B1 * | 4/2003 | Jaffe | 463/20 |
| 6,561,900 | B1 * | 5/2003 | Baerlocher et al. | 463/20 |
| 6,565,433 | B1 * | 5/2003 | Baerlocher et al. | 463/20 |
| 7,396,279 | B2 * | 7/2008 | Berman et al. | 463/16 |
| 2004/0048646 | A1 * | 3/2004 | Visocnik | 463/16 |
| 2006/0030387 | A1 * | 2/2006 | Jackson | 463/16 |

* cited by examiner

*Primary Examiner* — Jay Liddle
(74) *Attorney, Agent, or Firm* — McAndrews, Held Malloy, Ltd.

(57) ABSTRACT

A method of gaming comprising: conducting an initial play round comprising: selecting and displaying a first set of normal symbols at a plurality of display positions; displaying at least one special symbol at a display position; determining a game outcome based on each at least one special symbol and the first set of normal symbols, and conducting one or more further play rounds until an end condition is met, each further play round comprising: retaining the at least one special symbol from the previous play round; selecting a new display position at random for each retained special symbol; selecting and displaying a further set of normal symbols at a plurality of display positions; and determining a further game outcome based on the new display position of each special symbol and the further set of normal symbols.

7 Claims, 10 Drawing Sheets

740a 740b 740c 740d 740e

| | | | | |
|---|---|---|---|---|
| Queen | King | 10 | King | Jack |
| Ace | Man | Ace | Queen | 10 |
| Dog | Jack | 9 | 9 | 9 |

750a 750b 750c

710

Figure 7A 740a 740b 740c 740d 740e

| | | | | |
|---|---|---|---|---|
| King | 10 | Ace | 9 | King |
| Man | Queen | Queen | Jack | 10 |
| 9 | Jack | 10 | King | Dog |

750a 750b 750c

710

Figure 7B 740a 740b 740c 740d 740e

| | | | | |
|---|---|---|---|---|
| Man | 9 | King | Ace | 10 |
| Dog | Jack | Queen | Jack | Dog |
| Queen | 10 | Jack | 9 | Ace |

750a 750b 750c

710

Figure 7C 740a 740b 740c 740d 740e

| | | | | |
|---|---|---|---|---|
| 9 | Man | 9 | Ace | 10 |
| Dog | Dog | Dog | King | 9 |
| Queen | 10 | Jack | Woman | Ace |

750a 750b 750c 710 720

Figure 7D

METHOD OF GAMING, A GAMING SYSTEM AND A GAME CONTROLLER

CROSS REFERENCE TO RELATED APPLICATIONS

This application is a continuation of co-pending U.S. application Ser. No. 12/970,355, filed on Jan. 7, 2008, which claims priority to Australian Patent Application No. AU2007900072, having an international filing date of Jan. 9, 2007, entitled "A Method of Gaming, a Gaming System and a Game Controller", which is hereby incorporated by reference herein in its entirety.

FIELD

The present invention relates to a method of gaming, a gaming system and a game controller.

BACKGROUND TO THE INVENTION

Australian patent no. 755879 discloses a wild symbol which progressively moves to each of a predetermined number of display locations. The wild symbol follows a predetermined path after a single spinning of the reels. Game outcomes are determined for each position on the path.

Australian patent no. 762889 discloses holding a special symbol in the position where it occurs for at least one further game while at least the reel carrying the special symbol is re-spun.

It is also known from Australian patent no. 750731 to randomly locate a wild symbol, in the case of Australian patent no. 750731 by a "sprite" designating a symbol to be treated as a special symbol.

While these games provide some enjoyment, there is a need for an alternative gaming system.

SUMMARY OF THE INVENTION

In a first aspect there is disclosed a method of gaming comprising:

- conducting an initial play round comprising:
  - selecting and displaying a first set of normal symbols at a plurality of display positions;
  - displaying at least one special symbol at a display position;
  - determining a game outcome based on each at least one special symbol and the first set of normal symbols, and
- conducting one or more further play rounds until an end condition is met, each further play round comprising:
  - retaining the at least one special symbol from the previous play round;
  - selecting a new display position at random for each retained special symbol;
  - selecting and displaying a further set of normal symbols at a plurality of display positions; and
  - determining a further game outcome based on the new display position of each special symbol and the further set of normal symbols.

In an embodiment, the special symbol is displayed at a display position in the initial play round in response to a start condition being met.

In an embodiment, a new display position is selected by selecting a displacement at random from a set of possible displacements relative to the previously displayed position of the special symbol.

In an embodiment, the set of possible displacements are one display position in each of the directions left, right, up and down.

In another embodiment, the set of possible displacements are comprised of first displacement of two display positions in one of the directions left, right, up or down and a second displacement of one display position in a direction transverse to the first displacement. The first and second displacements may be reversed in some embodiments.

In some embodiments, the display positions define a rectangular display area and the left side is treated as contiguous with the right side and the bottom is treated as contiguous with the top such that all displacements correspond to a display position within the display area.

In an embodiment, there are two types of special symbols each of which is retained once they are displayed and each of which is moved independently.

In one embodiment, a first type of special symbol is displayed during the initial play round and a second type of special symbol is displayed initially during one of the further play rounds, both types of special symbol being retained and moved until an end condition is met.

In an embodiment, the end condition is that a predetermined number of play rounds have occurred.

In one embodiment, the end condition is that both types of special symbol are displayed in the same display position.

In an embodiment, the start condition is that the first set of normal symbols contains a predetermined symbol combination.

In an embodiment, there is more than one end condition and the game ends if any of the end conditions is met.

In an embodiment, at each display position associated with a special symbol only the special symbol is displayed. Thus, for example, the first special symbol may replace one of the first set of normal symbols. In another embodiment, the special symbols are displayed in conjunction with the normal symbol for that display position.

Depending on the embodiment, the first display position of the special symbol may be predetermined, randomly selected from the display positions, randomly selected from a subset of the display positions, or selected by a player.

Depending on the embodiment, the initial play round may be a first round of a feature game.

Depending on the embodiment, the initial play round may be conducted after the start condition is met or, a play round during which the special symbol appears on the display is deemed an initial play round.

In an embodiment, the normal symbols are symbols in a spinning reel game. In this embodiment, the display positions correspond to display of a plurality of reels and display of at least one, and preferably a plurality of symbols, of each reel. For example, five reels with three symbols per reel. In this embodiment, the symbols may be selected by selecting a stop position for each of the reels.

In a second aspect, there is disclosed a game controller comprising:

- a display;
- a symbol selector arranged to select a first set of normal symbols to be displayed by a display at a plurality of display positions and to display at least one special symbol at a display position in a first play round and to subsequently select a further set of normal symbols for each of one or more further play round, further play rounds being conducted until an end condition is met;

a special symbol controller arranged to:

retain each at least one special symbol in one or more further play rounds until the second condition is met, and select at random a new display position for each retained special symbol in each further play round; and an outcome generator arranged to determine game outcomes for each of the play rounds based on the display position of each special symbol and the set of normal symbols displayed in that play round.

In an embodiment, the special symbol controller comprises a new position selector arranged to select the new position of each special symbol.

In an embodiment, the new position selector is arranged to select a new position by selecting at random a displacement from a set of possible displacements relative to the previous display position of the special symbol.

In a third aspect, there is disclosed gaming system comprising:

a display;

a symbol selector arranged to select a first set of normal symbols to be displayed by the display at a plurality of display positions and to display at least one special symbol at a display position in a first play round and to subsequently select a further set of normal symbols for each of one or more further play round, further play rounds being conducted until an end condition is met;

a special symbol controller arranged to:

retain each at least one special symbol in one or more further play rounds until the second condition is met, and select at random a new display position for each retained special symbol in each further play round; and an outcome generator arranged to determine game outcomes for each of the play rounds based on the display position of each special symbol and the set of normal symbols displayed in that play round.

In a fourth aspect, there is disclosed computer readable program code, which when executed by a computer causes the computer to implement a computer implemented method of gaming comprising:

conducting an initial play round comprising:

selecting and displaying a first set of normal symbols at a plurality of display positions;

displaying at least one special symbol at a display position;

determining a game outcome based on each at least one special symbol and the first set of normal symbols, and conducting one or more further play rounds until an end condition is met comprising:

retaining each at least one special symbol from the previous play round;

selecting a new display position at random for each special symbol;

selecting and displaying a further set of normal symbols at a plurality of display positions; and determining a further game outcome based on the new display position of each special symbol and the further set of normal symbols.

In a fifth aspect, the invention provides a computer readable medium comprising the above computer program code.

In a sixth aspect, the invention provides a data signal comprising the above computer program code.

BRIEF DESCRIPTION OF THE DRAWINGS

An embodiment of the invention will now be described in relation to the following drawings in which:

FIGS. 7A to 7G show exemplary displays of a first example;

DETAILED DESCRIPTION

Figure 1:
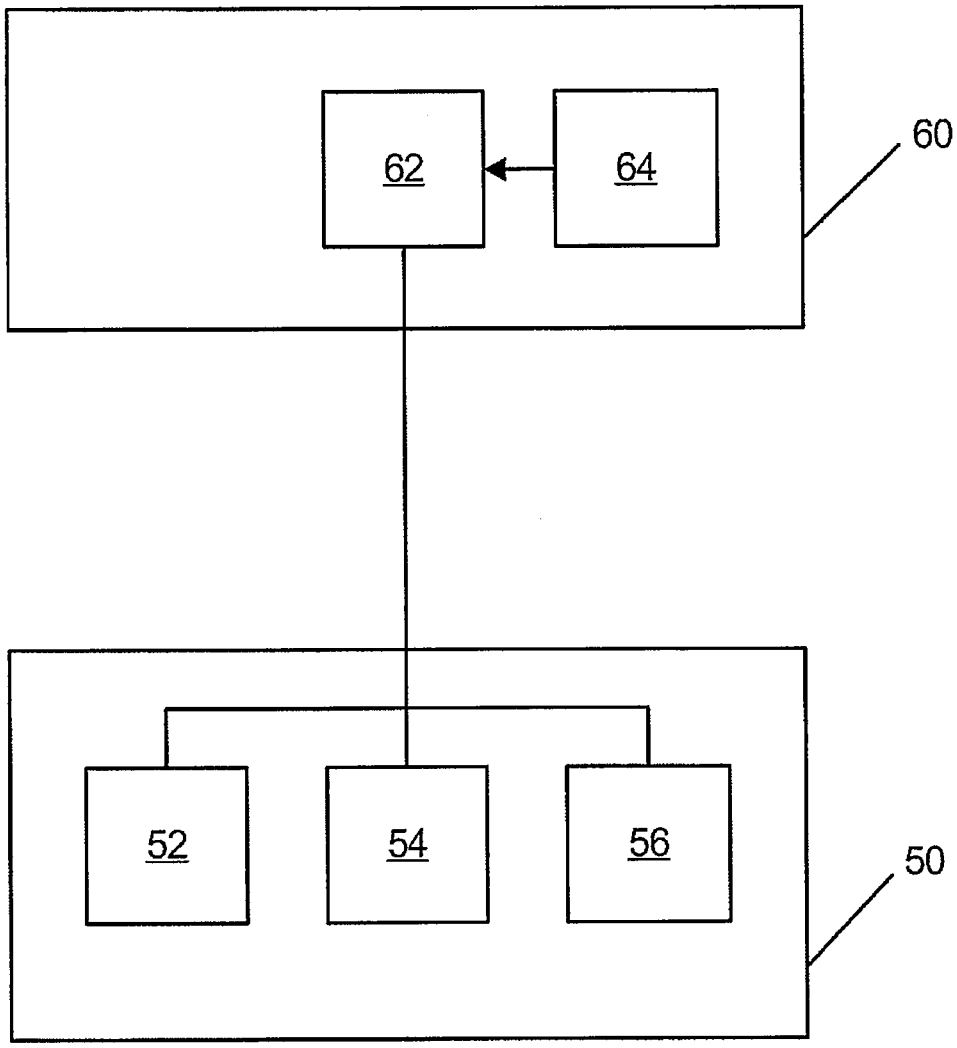
FIG. 1 is a block diagram of the core components of a gaming system.

Referring to the drawings, there is shown a gaming system arranged to implement a game where at least one special symbol is retained for one or more play rounds but is displayed at a randomly determined new display position after each play round. The gaming system can take a number of different forms.

In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system comprises several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions and play the game.

Components of the player interface may vary from embodiment to embodiment but will typically include a credit mechanism 52 to enable a player to input credits and receive payouts, one or more displays 54 and a game play mechanism 56 that enables a player to input game play instructions.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
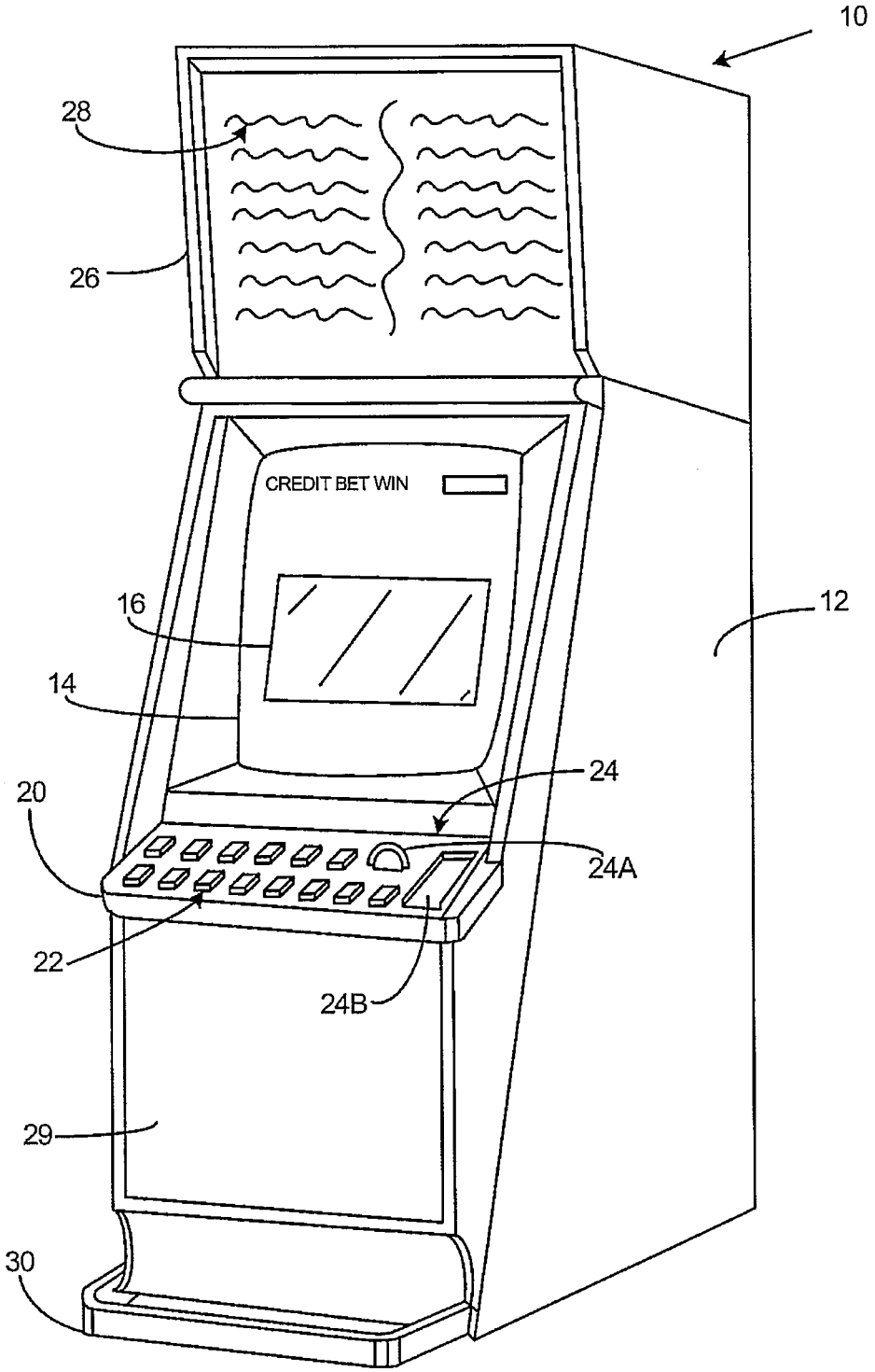
FIG. 2 is a perspective view of a gaming machine.

A gaming system in the form of a stand alone gaming machine 10 is illustrated in FIG. 2. The gaming machine 10 includes a console 12 having a display 14 on which is displayed representations of a game 16 that can be played by a player. A mid-trim 20 of the gaming machine 10 houses a bank of buttons 22 for enabling a player to interact with the gaming machine, in particular during gameplay. The mid-trim 20 also houses a credit input mechanism 24 which in this example includes a coin input chute 24A and a bill collector 24B. Other credit input mechanisms may also be employed, for example, a card reader for reading a smart card, debit card or credit card. A reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
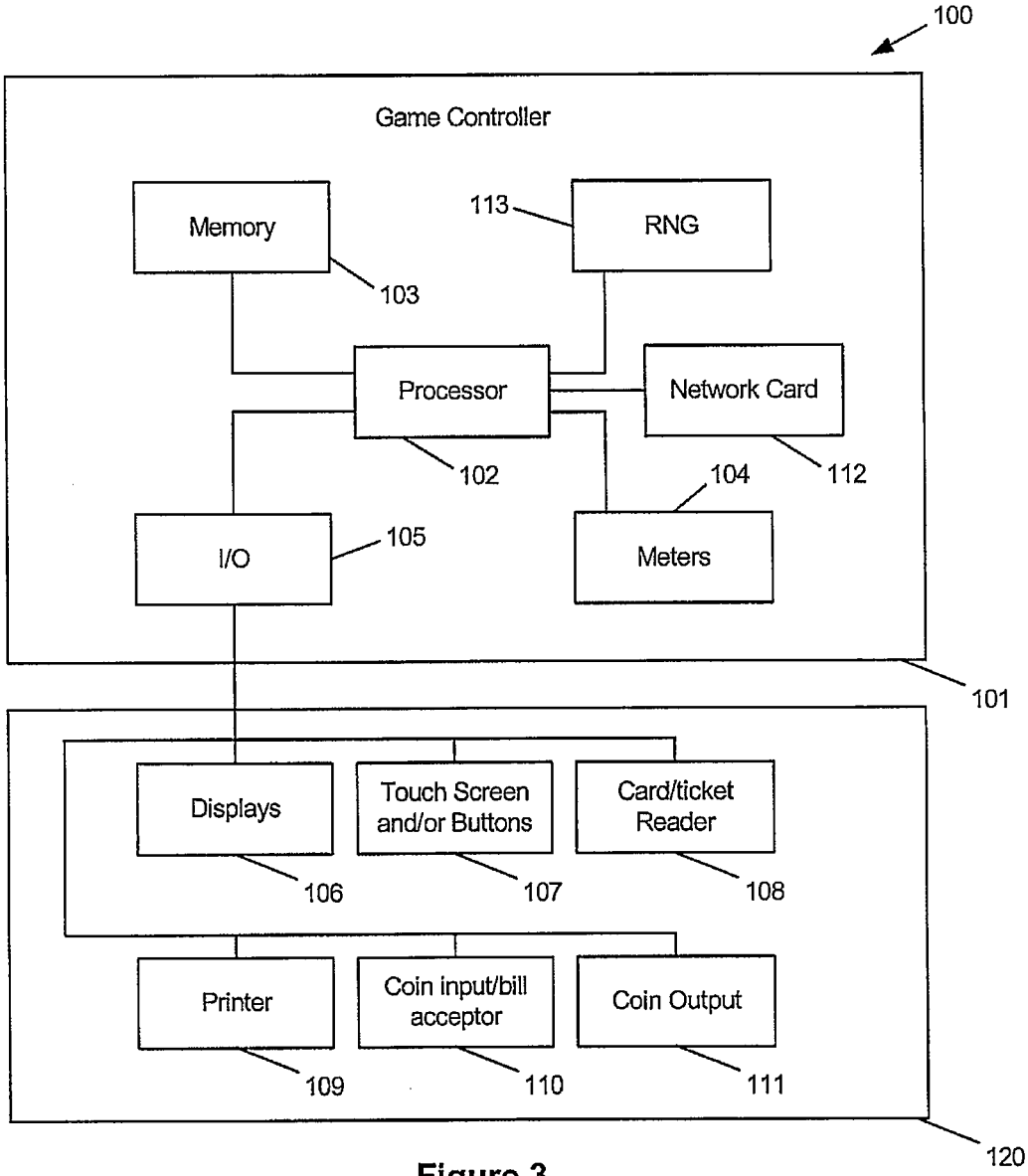
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 comprise one or more displays 106, a touch screen and/or buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

Figure 4:
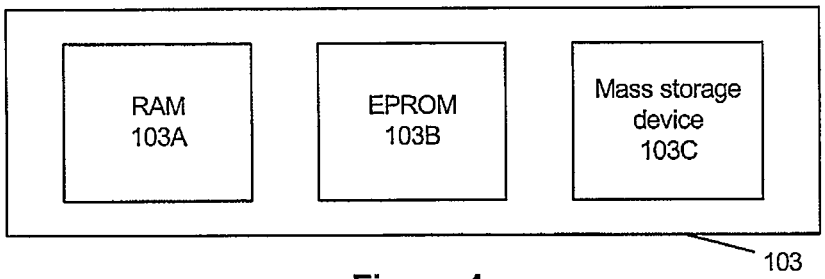
FIG. 4 is a block diagram representing the structure of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
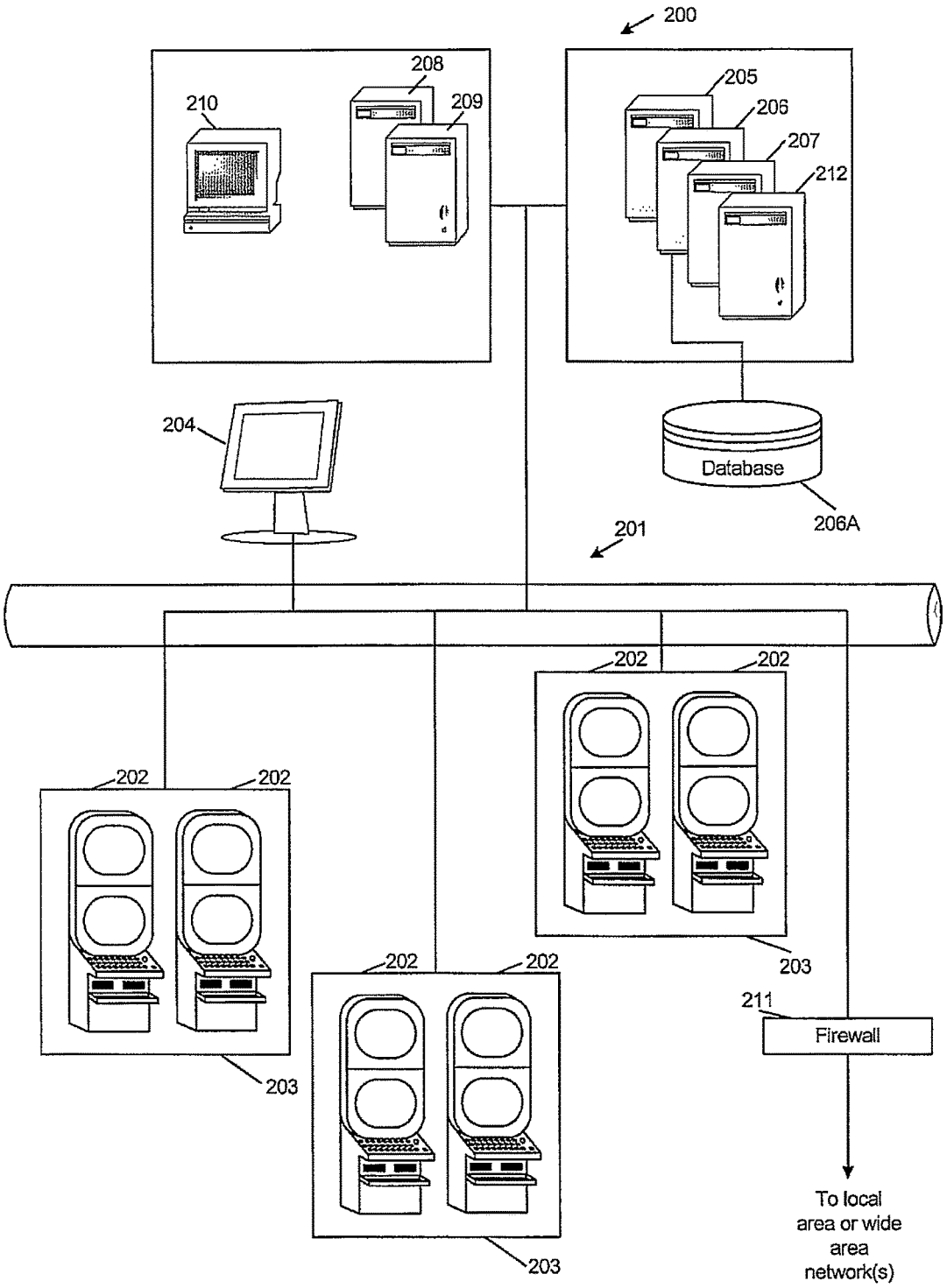
FIG. 5 is a diagram schematic of a networked gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to carry out accounting functions for the Jackpot game. A loyalty system 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming network 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of games servers could be provided to run different games or a single game server may run a plurality of different games as required by the terminals.

Gaming systems for implementing games that involve a display of spinning reels as part of the display of the outcome of a game have either a video display or a mechanical display, these later machines most usually being "stepper" machines which have a separate motor for each reel.

The game controllers of such gaming machines have a stop determining function that determines the stop position for each reel. For example, if there are five reels, each having twenty symbols, the stop determining function might determine that the stop positions are positions: 3, 13, 7, 9 and 17. The spinning of the reels is then controlled so that each symbol comes to a stop in the same row, typically a predetermined row in a "window" visible to the player on the display that which corresponds to a player playing a single win line. When a reel stops, the symbols will be in one of a plurality of possible symbol positions for that reel relative to the stop position.

Certain embodiments of the present invention relate to gaming systems that allow a player to select how many win lines of a plurality of win lines they will play in each game—i.e. a minimum of one win line up to the maximum number of win lines allowed by the game. Each win line is formed by a set of symbol positions consisting of one symbol position from each reel. That is, a predetermined symbol position of each reel is assigned to a win line. The symbol positions that constitute each of the win lines are usually advertised to the player by markings on the display or diagrams showing the symbol positions that correspond to each win line. Some of the win lines will be horizontal or diagonal lines but others may be other combinations of symbols. Typically, the win lines will be constituted by symbol positions in the visible window.

Persons, skilled in the art, will appreciate that in other embodiments, the player may obtain a win entitlement by select a number of reels to play. Such games are marketed under the trade name "Reel Power" by Aristocrat Leisure Industries Pty Ltd. The selection of the reel means that each symbol of the reel can be substituted for a symbol at one or more designated display positions. In other words, all symbol positions of a selected reel can be used to form symbol combinations with designated, displayed symbol positions of other reels.

In other embodiments a player may purchase access to particular pay tables—e.g. a first bet amount entitles the player to wins including cherries and a second amount entitles them to wins including plums.

Figure 6:
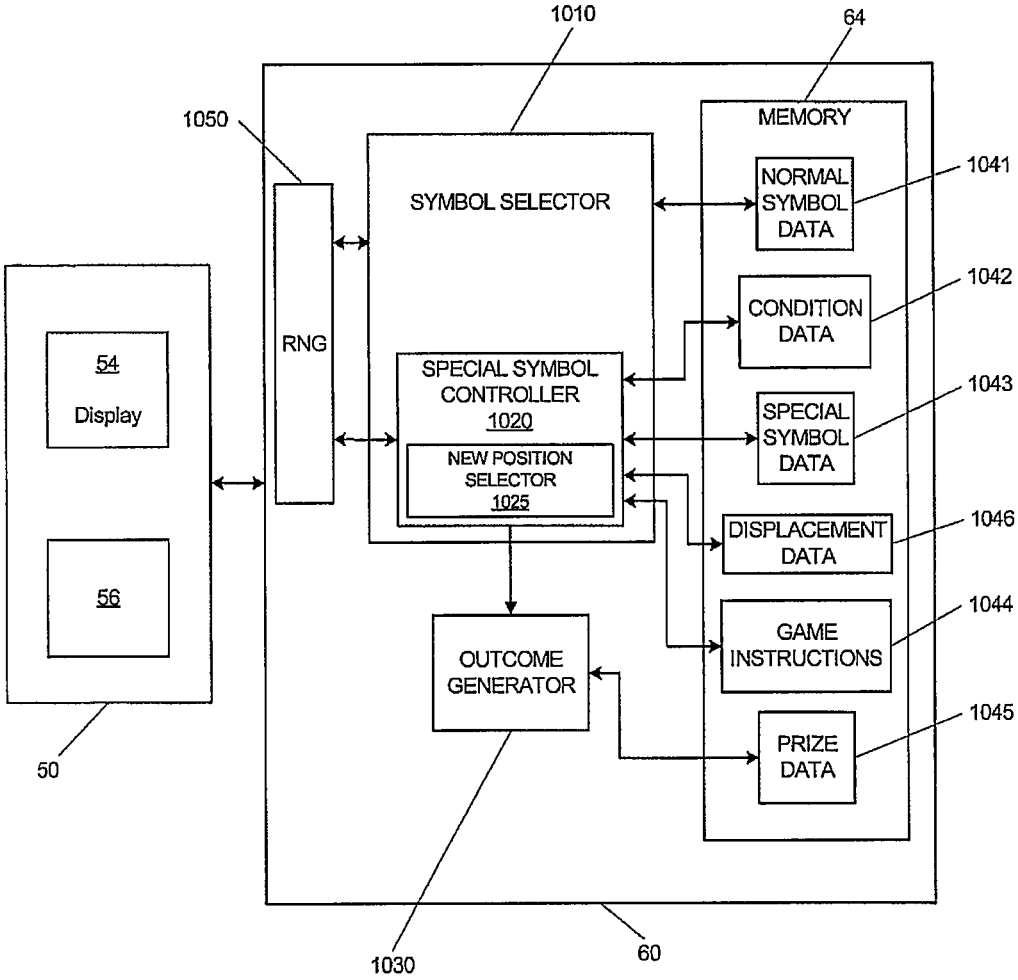
FIG. 6 is a further block diagram of the gaming system.

A game controller of an embodiment is shown in more detail in FIG. 6. Persons skilled in the art will appreciate that the game controller 60 and/or individual modules 1010-1050 of the game controller can be implemented by a processor executing appropriate program code stored in memory 64. In other embodiments, some modules may be provided by dedicated circuits, for example.

The game controller incorporates a symbol selector 1010 that selects symbols to appear on the display 54. Symbol selector 1010 includes a special symbol controller for controlling display of the special symbol during subsequent play rounds once it has appeared. In the embodiment, the special symbol controller 1020 of symbol selector 1010 is configured to determine based on a predetermined symbol combination occurring (specified by condition data 1042) that a special symbol should be displayed 54. In an alternative, the special symbol may be on one or more of the reels and accordingly would be part of symbol data specifying the makeup of each reel. In this embodiment, the start condition is that the special symbol appears on the display as a result of the normal selection process of symbols by the symbol selector 1010 under control of the random number generator 1050.

Once a special symbol either occurs or is displayed in response to a start condition being met, the special symbol is retained for one or more further play rounds until an end condition, specified by condition data 1042, is met. During each subsequent play round, the special symbol is displayed in a new position by being moved at random under control of the new position selector 1025. In an embodiment, the new position selector 1025 obtains a value from random number generator 1050 that is used to select a displacement from a set of displacements defined by displacement data 1046.

In some embodiments there may be more than one special symbol. In this case, the special symbol controller controls retainment and displacement of all special symbols.

Between each displacement of the special symbol (which will typically be a wild symbol that can substitute for all or some of the other symbols), a new set of normal symbols are obtained, for example by spinning the reels again. Other special symbols provide some form of additional play characteristic, for example a multiplier.

The outcome generator 1030 generates outcomes based on prize data 1045 and game instructions 1044 after each play round.

The above gaming system will normally be used to implement the game as a feature game. During the feature game, a set of games are played, described herein as play rounds, in which when a special symbol appears it is used to evaluate prizes and then the reels are spun and the symbol is retained in the window for use in the next game. The special symbol moves to a randomly selected new location, typically by a displacement selected at random from the location from which it last appeared.

The game is intended to be of particular interest in a game where the order of symbols is important in pay patterns.

As described above, the special symbol may be located on the reels and become active when it stops in the window. In this embodiment, there can be more than one special symbol on the reel and thus the number of special symbols can accumulate during the feature.

In another embodiment, the feature commences when a start condition is met, for example based on a specific symbol combination occurring on the reels, a special symbol is placed on the reel in a display location defined by the rules. Additional special symbols may also be added based on other factors defined in the rules of the game. The initial display location may, for example, be predetermined, selected at random, selected at random from a subset of the available display positions, or selected by the player.

A special symbol may be displayed such that the symbol shown on the reel strip underneath it is not visible (in embodiments where the special symbol is displayed independently of the reels). In an alternative embodiment, the special symbol is located in a place in the window such that the symbol shown on the reel strip is also visible, for example next to the symbol or as a transparent overlay. In one example, the special symbol may be larger than normal symbols and "float" over a display position.

In a further alternative, the special symbol may only be visible in conjunction with the symbol underneath when it appears in combination with certain symbols, for example, a scatter symbol where it is advantageous to keep both the wild and scatter symbols available for prize evaluations.

As described above, in the embodiment the special symbol is wild for some or all symbols. However, in alternative embodiments the special symbol may take another function for example as a multiplier or may act as a multiplier if more than one special symbol appears in the same display position. In a further alternative the special symbol may be a Jackpot symbol.

Where the random selection of a new display position of the retained special symbol is made by a displacement, this may be restricted to a set of possible displacements. For example, all displacements correspond to positions adjacent to the current position, or the displacements define a "dance step" such as two positions up and one across, etc. Further, the displacements may be allowed to wrap around the reels by moving adjacently up from a position from the top of the set of symbols to the bottom of the reels and similarly from right to left or left to right.

The held special symbols can be displayed in a number of different styles, for example:

- "walking", "dancing", "jumping" or "sliding" the symbol from one position to the next prior to the reels spinning;
- "walking", "dancing", "jumping" or "sliding" the symbol from one position to the next as the reels are spinning;
- "walking", "dancing", "jumping" or "sliding" the symbol from one position to the next after the reels spin; or
- visually disappearing as the reels are spun and then reappearing as the reels stop spinning.

It is possible to have more than one special symbol appearing in the window at the same time. If more than one special symbol appears in the same display position, the display position shows all of the special symbols. This can be visually depicted as the symbol changing to have all symbols in a new graphic or flashing between the various symbols.

Depending on the embodiment, where more than one special symbol appears in the same display position, the subsequent moves can be individual moves for each symbol or, alternatively, the combined symbol can now move as one symbol.

It is also possible for a special symbol to replicate as it is moved, and for it to be moved in multiple directions. For instance, in one embodiment, a special symbol of a Star can appear at Feature Game 1 and then at Feature Game 2, the Star is moved while being replicated as one star above the last position and one star below the last position.

The player's eligibility for the feature can be determined in accordance with any one of a number of known rules including but not limited to:

- being available to all players for all bets;
- being available only for certain bet types; or
- different levels of feature being available for different bets. For example, standard bets may be entitled to one special symbol and feature bets may be entitled to additional special symbols.

The feature can commence in accordance with any one of a number of known rules including but not limited to:

- when a special symbol, or a combination of symbols appears in the window;
- when a time elapses;
- when a system event occurs;
- when an underlying random event occurs, for example, in the course of a game;
- when a turnover has elapsed.

Persons skilled in the art will also appreciate that the method of the embodiment could be embodied in program code. The program code could be supplied in a number of ways, for example on a computer readable medium, such as a disc or a memory (for example, that could replace part of memory 103) or as a data signal (for example, by downloading it from a server).

Example 1

A three by five spinning reel game (five reels 740*a*-740*e* with three positions 750*a*-750*c* visible in the window for each reel) is being played at 1 credit per line and five lines. The game pays prizes in a left to right pattern only. Three scattered coin symbols appear on the reels and trigger a series of eight feature games.

During the feature games, the rules of the game define that the "Man" special symbol and the "Woman" special symbol each acquire the function of substituting for other symbols. During the feature, once a Man or Woman special symbol appears, the special symbol will remain in the window for all remaining games in this feature sequence but will randomly move location. The location of the displacement is defined as moving up or down on the same reel, or moving left to right on the same row.

Please note that in this example the adjacent move includes a "wrap" i.e. the meaning of the word "up" includes moving from the top line to the bottom line on the same reel. Similarly, the word "down" includes moving from the bottom line to the top line on the same reel. Similarly the word "left" includes moving from reel one to reel five and "right" includes moving from reel five to reel one.

The displacement selector randomly selects to which position the special symbol is to move.

More than one "Man" and one "Woman" can appear and be retained in each feature sequence. The rules of the game define that if a Man and Woman occupy the same position, the visual display will show the Man and Woman dancing together and the prize will be multiplied by ten. Similarly if two "Man" or two "Woman" symbols occupy the same position.

In the first free game, neither a Man nor a Woman symbol appears on the reels. The symbols appearing on the reels are evaluated and prizes paid.

In the second free game, a Man symbol 710 appears on reel two 740*b* in the centre position 750*b*. The symbols appearing in the window are evaluated for prizes according to the bet options placed by the player and using the Man as a substitute as shown in FIG. 7A.

This outcome pays 3*Aces on the centre line (Man substitutes for the Ace)

In the third free game, the Man 710 remains available in the window but moves location. The displacement is random but can only move up or down on reel two or sideways onto reel one or reel three. The reels also spin and all other symbols are replaced. The outcome is shown in FIG. 7B.

The outcome pays 3*Queen on the centre line (Man substitutes for Queen)

In the fourth free game, the Man 710 remains available in the window but moves location. The displacement is random but can only move up or down on reel one or sideways onto reel five or reel two. The reels also spin and all other symbols are replaced. The outcome is shown in FIG. 7C.

The outcome pays 4*jack on the fourth payline (top left hand corner to middle bottom, then up to top right hand corner. (Man substitutes for Jack)

And 2*9 on top line (Man substitutes for 9)

In the fifth free game, the Man 710 remains available in the window but moves location. The displacement is random but can only move up (to the bottom position) or down on reel one or sideways onto reel five or reel two. The reels also spin and all other symbols are replaced. On this outcome, a Woman 720 symbol appears on reel four. The outcome is shown in FIG. 7D.

The outcome pays 3*9 on top line. (Man substitutes for 9)

And 3*dog on the centre line. The "Woman" does not complete a prize winning combination.

Figure 7E:
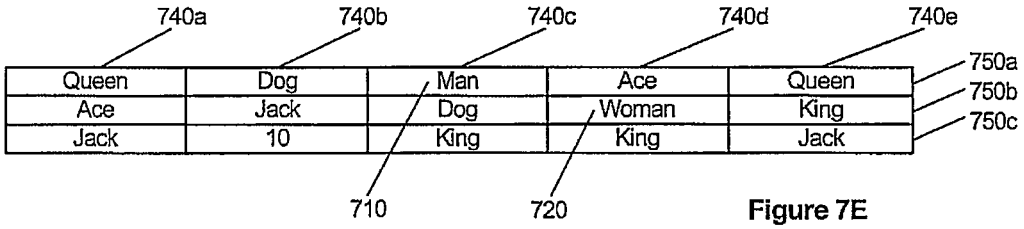

In the sixth free game, the Man 710 remains available in the window but moves location. The displacement is random but can only move up (to the bottom position) or down on reel two or sideways onto reel one or reel three. The Woman 720 can move up or down (to the top position on reel four) or sideways onto reel three or five. The reels also spin and all other symbols are replaced. The outcome is shown in FIG. 7E.

The outcome pays 5*Jacks on fifth payline. (Man and Woman both substitute for Jack) fifth payline runs from reel one bottom position to reel three top position and down to bottom position on reel five.

Figure 7F:
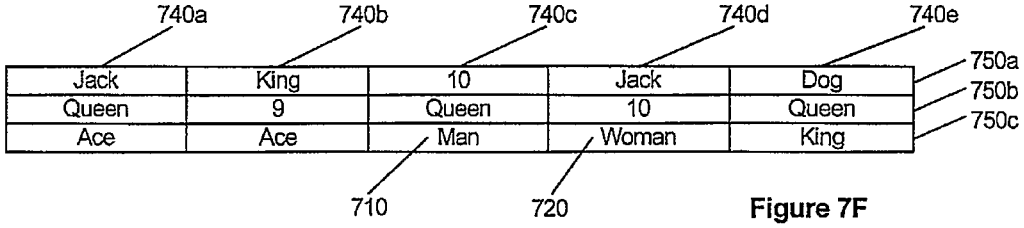

In the seventh free game, the Man 710 remains available in the window but moves location. The displacement is random but can only move up (to the bottom position) or down on reel three or sideways onto reel two or reel four. The Woman 720 can move up or down or sideways onto reel three or five. The reels also spin and all other symbols are replaced. The outcome is shown in FIG. 7F The outcome pays 4*Aces on bottom payline. (Man and Woman both substitute for Ace).

Figure 7G:
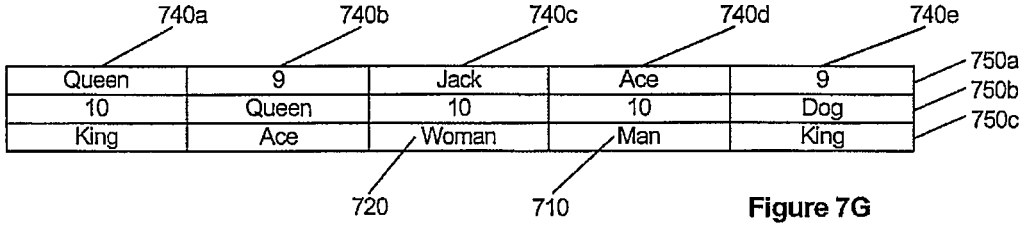

In the eighth free game, the Man 710 remains available in the window but moves location. The displacement is random but can only move up or down on reel three or sideways onto reel two or reel four. The Woman 720 can move up or down or sideways onto reel three or five. The reels also spin and all other symbols are replaced. The outcome is shown in FIG. 7G.

The outcome pays 3*Queens on fourth payline. (Woman substitutes for Queen).

The Man does not complete a winning combination.

Eight feature games are now complete, the end condition is met and the game returns to normal play.

Figure 8:
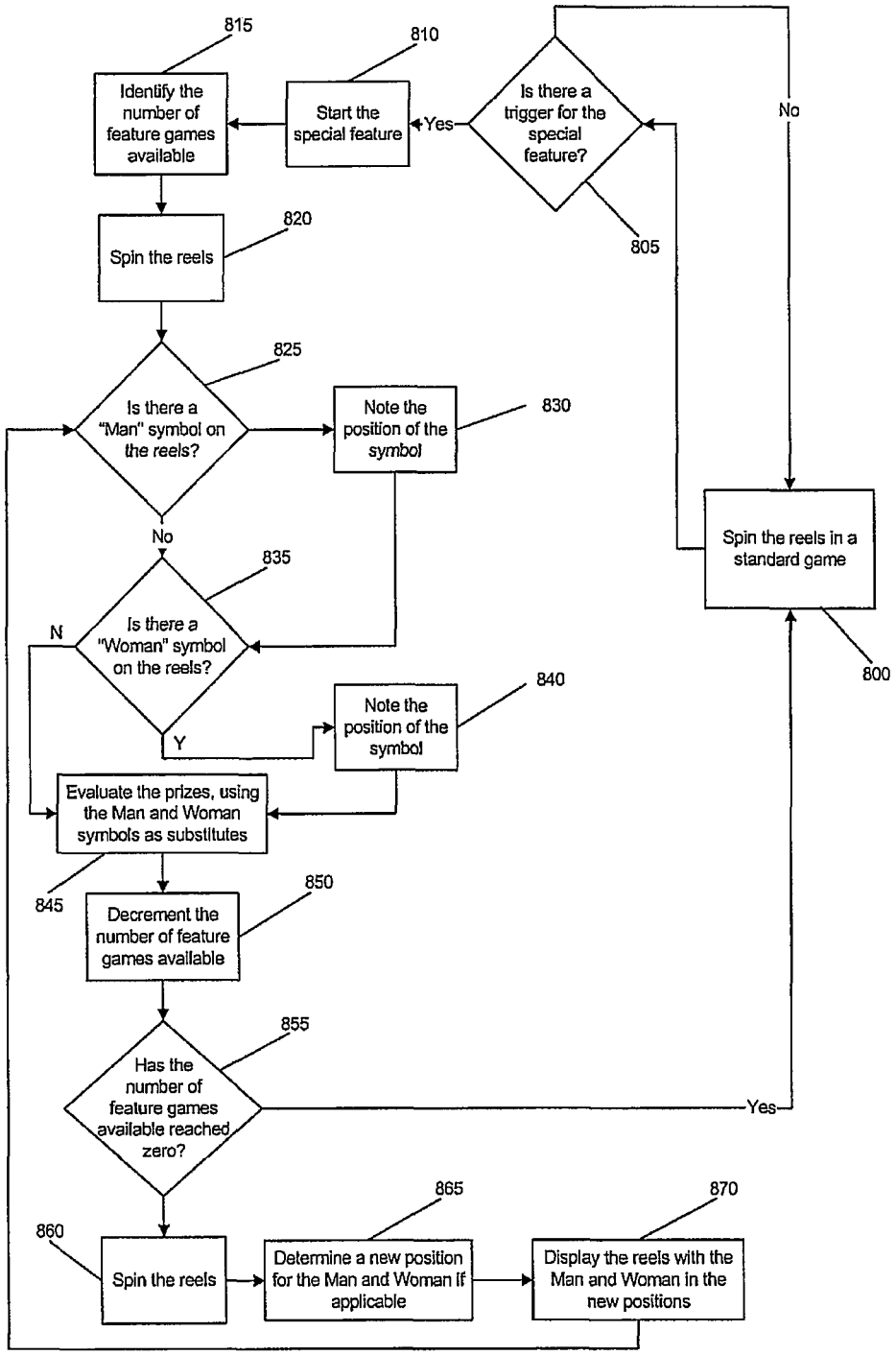
FIG. 8 is a flowchart of the first example.

The process of Example 1 is illustrated in the flow chart of FIG. 8. At step 800, the reels are spun in a standard game. At step 805, it is determined whether there is a trigger (start condition) for the special feature. If no, the standard game continues, if yes, the feature game is started at step 810. At step 815, it is determined what the end condition will in this case is the number of feature games that are available in this game. At step 820, the reels are spun. At step 825, it is determined whether there is a Man symbol on the reels, as in this embodiment the Man symbol is one of the set of symbols available on at least one reel. If the answer is yes, the position is noted if the answer is no, it is determined 835 whether there is a Woman symbol on the reels. If the answer is yes, the position is noted at step 840 and prizes are evaluated at step 845. If there are any Man or Woman symbols, these are used as substitutes otherwise the prize evaluation occurs in accordance with the other normal rules. At step 850, the number of feature games that are available is decremented and at step 855 it is determined whether the number of feature games available has reached zero 855. If the answer is no, the process proceeds to step 860, and the reels are spun, at steps 865 and 870, new positions are determined for the man and woman if this is applicable. The process then continues from step 825 until it is determined at step 855 that the number of feature games has reached zero. That is, that the end condition is met.

Example 2

This is another five reel 940*a*-940*e* by three row 950*a*-950*c* game where the rules are the same as Example 1 but a Man 910 and Woman 920 symbol are placed on the display at the start of the game.

Figure 9A:
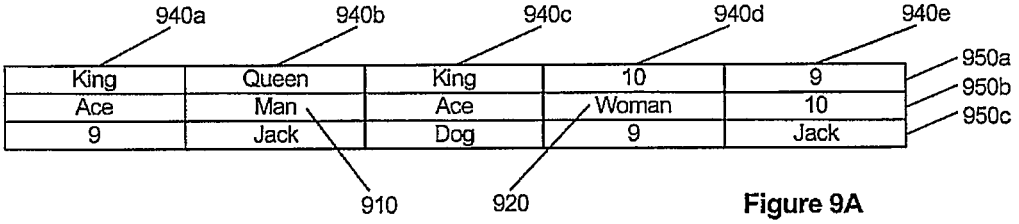
FIGS. 9A to 9H show exemplary displays of a second example.

In the first free game, a Man symbol 910 is placed on reel two, centre position and a Woman symbol 920 is placed on the reel four, centre position. The symbols overlay other symbols such that the underlying symbols, except for scatters, cannot be seen and cannot be used to evaluate prizes. The symbols appearing on the reels are evaluated and prizes paid. The outcome is shown in FIG. 9A.

The prizes paid are

4*Aces on the centre line (Man and Woman substitute for Ace)

2*9 on the fifth payline (Man substitutes for 9)

In the second free game, the Man 910 symbol randomly relocates. The relocation can be above or below the centre position on reel two or to the centre position on reel one or reel three. The displacement of the Woman 920 symbol is independent of the displacement of the Man 910. The Woman can move up or down on reel four or sideways to reels three or five on the centre position. The symbols appearing in the window are evaluated for prizes using the Man and Woman as a substitute.

This outcome pays:

3*Aces on the centre line (Man substitutes for the Ace)

Figure 9B:
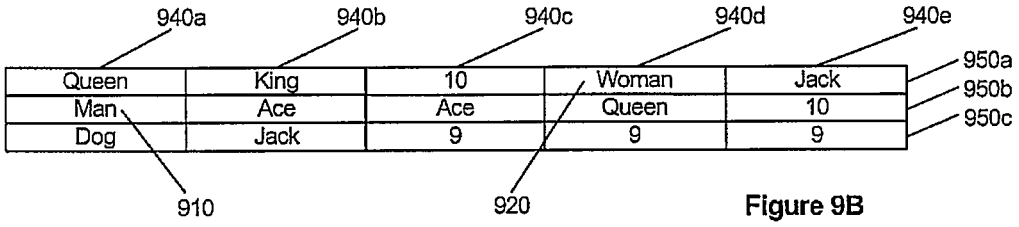
Figure 9C:
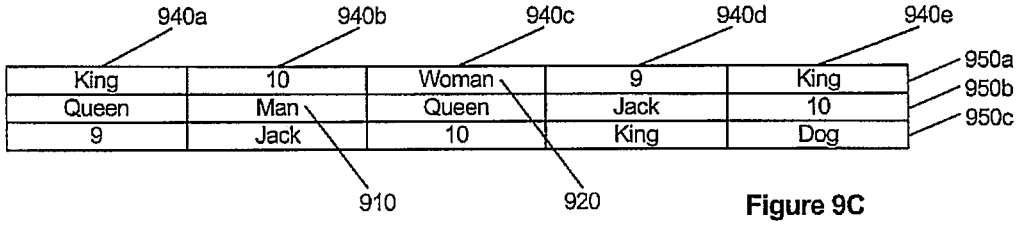

In the third free game, the Man 910 remains available in the window but moves location. The displacement is random but can only move up or down on reel one or sideways onto reel five or reel two. Similarly for the relocation of the Woman 920. The reels also spin and all other symbols are replaced. The outcome is shown in FIG. 9B.

The outcome pays:

3*Queen on the centre line (Man substitutes for Queen)

3*9 on fifth payline (Man and woman substitute for 9)

Figure 9D:
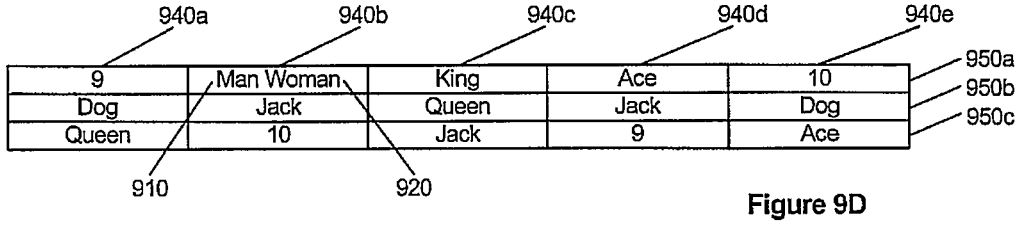

In the fourth free game, the Man 910 remains available in the window but moves location. The displacement is random but can only move up or down on reel two or sideways onto reel one or reel three. Similarly, the Woman 920 symbol must relocate. The reels also spin and all other symbols are replaced. The outcome is shown in FIG. 9D.

Note that in this outcome, the Man and Woman symbols are now in the same position.

The outcome pays on top line 2*9 prize time ten. (Man and woman at the same location pay ten times the prize and substitutes for 9)

Figure 9E:
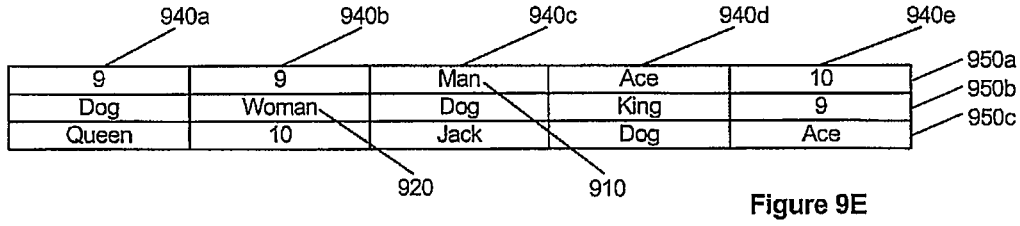

In the fifth free game, the Man 910 remains available in the window but moves location. The displacement is random but can only move up (to the bottom position) or down on reel two or sideways onto reel three or reel one. Similarly the Woman 920 relocates. The reels also spin and all other symbols are replaced. The outcome is show in FIG. 9E.

The outcome pays:

3*9 on top line. (Man substitutes for 9)

3*dog on the centre line. (Woman substitutes for dog)

3* Queen on fifth payline (Man and Woman substitute for Queen)

2*9 on fourth payline (Woman substitutes for 9)

Figure 9F:
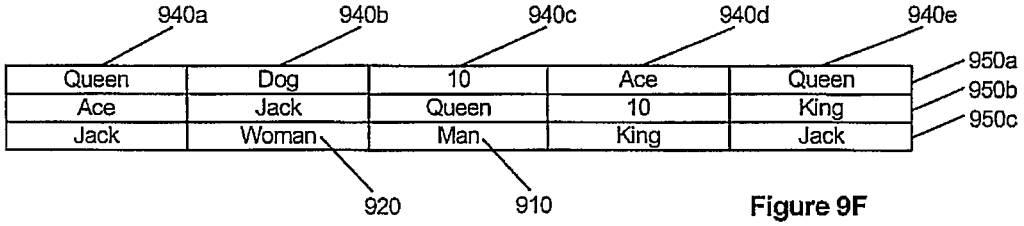

In the sixth free game, the Man 910 remains available in the window but moves location. The displacement is random but can only move up (to the bottom position) or down on reel three or sideways onto reel two or reel four. Similarly the Woman 920 relocates. The reels also spin and all other symbols are replaced. The outcome is shown in FIG. 9F.

The outcome pays:

3*Jacks on bottom payline. (Man and Woman both substitute for Jack)

Figure 9G:
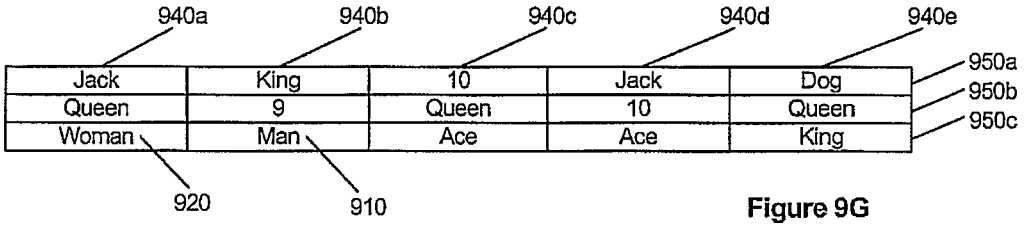

In the seventh free game, the Man 910 remains available in the window but moves location. The displacement is random but can only move up or down on reel three or sideways onto reel two or reel four. Similarly, the Woman 920 relocates. The reels also spin and all other symbols are replaced. The outcome is shown in FIG. 9G.

The outcome pays:

4*Aces on bottom payline. (Man and Woman both substitute for Ace).

2*9 on fifth payline

Figure 9H:
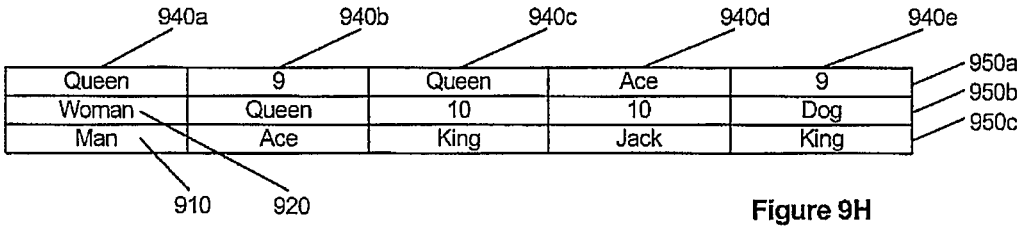

In the eighth free game, the Man 910 remains available in the window but moves location. The displacement is random but can only move up or down on reel two or sideways onto reel one or reel three. Similarly, the Woman 920 relocates. The reels also spin and all other symbols are replaced. The outcome is shown in FIG. 9H.

The outcome pays:

3*Queens on fifth payline. (Man substitutes for Queen).

Eight feature games are now complete and the game returns to normal play.

In one variation of Example 2, the Man and Woman symbols may move together after they appear in the same display position (see FIG. 9D). When they move together this may be different to the initial way they moved, for example, they may move in a two by one or one by two display position "dance step".

Persons skilled in the art will appreciate that various variations may be made to the invention without departing from the scope of the invention described herein.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

The claims defining the invention are as follows:

1. A gaming system comprising:

a credit input mechanism configured for player interaction to receive a physical item representing a monetary value for receiving a credit input and establishing a credit balance, the credit balance being increasable and decreasable based at least on wagering activity;

a manually operable player interface configured to place a wager in accord with said credit balance having been provided by the credit input mechanism;

a game display;

a game controller having a random number generator, and configured to conduct an initial play round in accord with the placed wager, including being configured to:

1) select via the random number generator in the initial play round a first set of symbols from a plurality of available symbols that includes at least one special symbol, 2) cause the display of the selected first set of symbols at a respective plurality of display positions on the game display, and 3) determine a first game outcome based on the selected first set of symbols and any special symbols that are selected and displayed; and 4) award at least one prize based on said first game outcome; and wherein said game controller is further configured to conduct at least one further play round until an end condition is met, including being configured to:

1) determine if a special symbol was displayed in the previous play round, and if so retain the special symbol for the further play round;

2) select at random a new display position for each retained special symbol based upon a set of predetermined displacement rules;

3) select via the random number generator a further set of symbols from a plurality of available display symbols;

4) display the selected further set of symbols at a respective plurality of display positions, including being configured to determine if two or more of the special symbols have been randomly assigned to the same display position for the current play, to combine the two or more special symbols for the current play round when the same display position is randomly selected for at least two special symbols, to separate any combined special symbols from the previous round into the constituent two or more special symbols, and to randomly via the random number generator move the constituent two or more special symbols based on a set of predetermined displacement rules;

5) determine a further game outcome based on the retained special symbol from the previous play round, the selected symbols from the further set of symbols, and any additional special symbol from the further set of symbols;

6) award prizes based on said further game outcome, including awarding an enhanced prize when two or more special symbols have been assigned to the same display position; and a payout mechanism configured to payout value in accordance with the credit balance.

2. A gaming system as claimed in claim 1, wherein the game controller is configured to select a new position for a special symbol by selecting at random a displacement from a set of possible displacements relative to the previous display position of the special symbol based upon said first set of predetermined displacement rules.

3. A gaming system as claimed in claim 1, wherein the set of possible displacements are comprised of first displacement of two display positions in one of the directions left, right, up or down and a second displacement of one display position in a direction transverse to the first displacement.

4. A gaming system as claimed in claim 1, wherein the display positions define a rectangular display area and the left side is treated as contiguous with the right side and the bottom is treated as contiguous with the top such that all displacements result in the moved symbol moving to a display position within the display area.

5. A gaming system as claimed in claim 1, wherein the end condition is that a predetermined number of play rounds have occurred.

6. A gaming system as claimed in claim 1, wherein the symbols belong to a plurality of reels in a spinning reel game.

7. A game system as claimed in claim 1, wherein the controller is adapted to increase a prize award by a predetermined amount in response to determining that two or more of the special symbols have been randomly displayed in a same display position during the at least one or more further play round.

* * * * *